US011266554B2

(12) United States Patent
Poulos et al.

(10) Patent No.: US 11,266,554 B2
(45) Date of Patent: Mar. 8, 2022

(54) BED BASE FRAME

(71) Applicant: Kreg Medical, Inc., Melrose Park, IL (US)

(72) Inventors: Craig Poulos, Chicago, IL (US); Tho Qg. Thieu, Chicago, IL (US); Carlos Portillo, Chicago, IL (US)

(73) Assignee: Kreg Medical, Inc., Melrose Park, IL (US)

( * ) Notice: Subject to any disclaimer, the term of this patent is extended or adjusted under 35 U.S.C. 154(b) by 68 days.

(21) Appl. No.: 16/124,911

(22) Filed: Sep. 7, 2018

(65) Prior Publication Data

US 2019/0076310 A1 Mar. 14, 2019

Related U.S. Application Data

(60) Provisional application No. 62/555,935, filed on Sep. 8, 2017.

(51) Int. Cl.

| | |
|---|---|
| ***A61G 7/053*** | (2006.01) |
| ***A61G 7/008*** | (2006.01) |
| ***A61G 7/018*** | (2006.01) |
| ***A61G 7/012*** | (2006.01) |
| ***A61G 7/05*** | (2006.01) |
| *A61G 7/015* | (2006.01) |
| *A61G 7/10* | (2006.01) |

(52) U.S. Cl.

CPC ..... *A61G 7/053* (2013.01); *A61G 7/008* (2013.01); *A61G 7/012* (2013.01); *A61G 7/018* (2013.01); *A61G 7/0528* (2016.11); *A61G 7/015* (2013.01); *A61G 7/1046* (2013.01); *A61G 7/1067* (2013.01); *A61G 2200/16* (2013.01); *A61G 2203/70* (2013.01)

(58) Field of Classification Search

CPC ..... A61G 7/053; A61G 7/0528; A61G 7/008; A61G 7/012; A61G 7/018; A61G 7/045; A61G 7/1046; A61G 7/1067; A61G 2200/16; A61G 2203/70

See application file for complete search history.

(56) References Cited

U.S. PATENT DOCUMENTS 1,133,798 A * 3/1915 Hall ..... B60B 33/06 16/32
1,253,179 A * 1/1918 Irrgang ..... B60B 33/06 16/32

(Continued)

*Primary Examiner* — Robert G Santos
*Assistant Examiner* — Rahib T Zaman
(74) *Attorney, Agent, or Firm* — Leydig, Voit & Mayer, Ltd.; John Augustyn

(57) ABSTRACT

A bed base frame assembly of a bed generally comprises a base frame, a plurality of steerable and lockable casters, a lateral support assembly at the first and second sides of the base frame assembly, and an in-line support assembly at the foot end of the base frame assembly. The lateral support assembly may further include: a base frame; a first leg and a second leg rotatably connected to the base frame; a first actuator connected to the first leg and the second leg, wherein the first leg and the second leg rotate from the retracted position to the extended position; a third leg and a fourth leg rotatably connected to the base frame; and a second actuator connected to the third leg and the fourth leg, wherein the third leg and the fourth leg rotate from the retracted position to the extended position.

47 Claims, 11 Drawing Sheets

(56) References Cited

U.S. PATENT DOCUMENTS 1,636,325 A * 7/1927 Roe ..... B60B 33/06 16/33
1,999,106 A * 4/1935 Muller ..... B60B 33/06 16/34
2,262,288 A * 11/1941 Klipstein ..... D06F 39/125 188/152
2,675,285 A * 4/1954 Terry ..... A61G 13/009 5/618
2,783,055 A * 2/1957 Michaud ..... B62B 3/0625 280/43.14
2,830,304 A * 4/1958 Ericsson ..... A61G 7/08 5/11
3,174,161 A * 3/1965 Black ..... A61G 7/002 5/616
3,422,929 A * 1/1969 Oja ..... B62B 5/049 188/5
3,877,088 A 4/1975 Bouman
3,997,926 A 12/1976 England
4,346,487 A 8/1982 Holdt
4,545,084 A 10/1985 Peterson
4,709,790 A 12/1987 Freitag et al.
4,724,554 A 2/1988 Kowalski et al.
4,724,555 A 2/1988 Poehner et al.
4,953,243 A 9/1990 Birkmann
5,129,116 A 7/1992 Borders et al.
5,329,657 A 7/1994 Bartley et al.
5,347,682 A * 9/1994 Edgerton, Jr. ..... A61G 7/012 16/32
5,366,036 A 11/1994 Perry
5,454,126 A 10/1995 Foster et al.
5,479,666 A 1/1996 Foster et al.
5,513,406 A 5/1996 Foster et al.
5,542,136 A 8/1996 Tappel
5,577,279 A 11/1996 Foster et al.
5,620,066 A 4/1997 Schuttler
5,666,681 A 9/1997 Meyer et al.
5,692,256 A 12/1997 Kramer et al.
5,715,548 A 2/1998 Weismiller et al.
6,000,076 A 12/1999 Webster et al.
6,112,867 A 9/2000 Mintgen et al.
6,151,739 A 11/2000 Meyer et al.
6,212,714 B1 4/2001 Allen et al.
6,296,089 B1 10/2001 Koch et al.
6,336,235 B1 1/2002 Ruehl
6,351,863 B1 3/2002 Meyer et al.
6,496,993 B2 12/2002 Allen et al.
6,539,566 B1 4/2003 Hayes
6,611,979 B2 9/2003 Welling et al.
6,684,427 B2 2/2004 Allen et al.
6,862,762 B1 3/2005 Johnson et al.
7,000,272 B2 2/2006 Allen et al.
7,086,107 B2 8/2006 Ellis et al.
7,182,323 B2 2/2007 Muller
7,213,279 B2 5/2007 Weismiller et al.
7,216,389 B2 5/2007 Ellis et al.
7,237,471 B2 7/2007 Mintgen et al.
7,263,734 B1 9/2007 Buchanan et al.
7,296,312 B2 11/2007 Menkedick
7,509,698 B2 3/2009 Poulos et al.
7,523,515 B2 4/2009 Allen et al.
7,536,739 B2 5/2009 Poulos et al.
7,568,247 B2 8/2009 Strobel et al.
7,587,776 B2 9/2009 Poulos et al.
7,676,862 B2 3/2010 Poulos et al.
7,716,766 B2 5/2010 Poulos et al.
7,743,441 B2 6/2010 Poulos et al.
7,757,318 B2 7/2010 Poulos et al.
7,779,494 B2 8/2010 Poulos et al.
7,784,128 B2 8/2010 Kramer
7,793,950 B2 * 9/2010 Van Eeden ..... A61G 5/0883 280/87.041
7,832,528 B1 * 11/2010 Liang ..... B60T 1/14 188/5
7,836,531 B2 11/2010 Girard
8,056,160 B2 11/2011 Poulos et al.
8,063,785 B2 11/2011 Sacchetti
8,069,514 B2 12/2011 Poulos et al.
8,104,122 B2 1/2012 Richards et al.
8,104,123 B2 1/2012 Paz et al.
RE43,155 E 2/2012 Allen et al.
8,539,625 B2 9/2013 Poulos et al.
8,590,073 B2 * 11/2013 Bly ..... A61G 7/0528 5/510
8,793,824 B2 8/2014 Poulos et al.
9,119,753 B2 9/2015 Poulos et al.
9,320,663 B2 4/2016 Poulos et al.
9,687,401 B2 6/2017 Alford et al.
10,064,771 B2 9/2018 Poulos et al.
10,179,077 B2 1/2019 Poulos et al.
10,617,582 B2 4/2020 Poulos et al.
10,744,054 B2 8/2020 Poulos et al.
2002/0059679 A1 5/2002 Weismiller
2003/0172459 A1 * 9/2003 Roussy ..... A61G 7/0528 5/611
2006/0026762 A1 * 2/2006 Hornbach ..... A61G 7/0528 5/611
2006/0059621 A1 3/2006 Poulos et al.
2006/0260051 A1 11/2006 Paz
2006/0277683 A1 12/2006 Lamire
2007/0080030 A1 * 4/2007 Kramer ..... B62B 5/049 188/5
2007/0163043 A1 7/2007 Lemire et al.
2007/0169267 A1 7/2007 Paz et al.
2007/0234477 A1 * 10/2007 Dorenbeck ..... A47C 19/045 5/618
2008/0086815 A1 4/2008 Kappeler et al.
2008/0211248 A1 9/2008 Lambarth
2010/0005592 A1 1/2010 Poulos et al.
2010/0325794 A1 * 12/2010 Chung ..... A47C 21/006 5/103
2011/0113556 A1 * 5/2011 Roussy ..... A61G 1/017 5/611
2012/0066832 A1 3/2012 Poulos et al.
2012/0198613 A1 * 8/2012 Jelinek ..... A61G 7/1046 5/86.1
2013/0139318 A1 6/2013 Paz
2013/0145550 A1 6/2013 Roussy et al.
2015/0297432 A1 * 10/2015 Poulos ..... A61G 7/0513 5/610
2016/0074265 A1 * 3/2016 Lyon ..... B60B 33/021 5/600
2017/0281440 A1 * 10/2017 Puvogel ..... A61G 7/005
2019/0142671 A1 5/2019 Poulos et al.
2019/0142672 A1 5/2019 Poulos et al.
2019/0142673 A1 5/2019 Poulos et al.
2020/0008994 A1 1/2020 Poulos et al.
2020/0008995 A1 1/2020 Poulos et al.

* cited by examiner

BED BASE FRAME

This application claims priority to Provisional Application, U.S. Ser. No. 62/555,935, filed Sep. 9, 2017, and titled "Bed Base Frame" which is incorporated herein by reference in its entirety.

TECHNICAL FIELD

The present disclosure relates generally to a patient support, and more specifically to a bed base frame that supports additional bed frames that are positionable to assist a patient to a standing position, or to any angular position between 0° (i.e., horizontal, lying position) and approximately 90° (i.e., vertical, standing position), and further to a bed base frame that has lateral supports.

BACKGROUND

Hospital beds are well known in the art. While hospital beds according to the prior art provide a number of advantageous features, they nevertheless have certain limitations. The present disclosure seeks to overcome certain of these limitations and other drawbacks of the prior art, and to provide new features not heretofore available. A full discussion of the features and advantages of the present disclosure is deferred to the following detailed description, which proceeds with reference to the accompanying drawings.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Aspects of this disclosure may relate to a support assembly for a bed that comprises a base frame, a first support connected to the base frame; a first leg connected to the first support; a second support connected to the base frame; a second leg connected to the second support; and an actuator connected to the first leg and the second leg to cause the first and second legs to move from a retracted position to an extended position. The support assembly may further include an extension connected to a first and second end of the actuator and a linkage connecting the extension to each of the legs. Further, in the retracted position, the legs may be substantially parallel to a side member of the base frame and in the extended position, the legs may be transverse to the side member of the base frame. The first support and the second support may each comprise a flange portion and a shaft portion, with the shaft portion angled inwardly toward an opposing side of the base frame such that a longitudinal axis of the shaft portion is transverse to a vertical axis extending through a side member of the base frame. The flange portion, the linkage, and the extension may form a three-bar linkage mechanism whereby linear motion of the extension is converted into rotational motion of the legs. A first end of the actuator may include a receiver and a second end of the actuator opposite the first end may include an actuator shaft, wherein the actuator shaft transitions outwardly and inwardly from the actuator. The support assembly may further include an emergency release to allow the first and second legs to be disassociated with the actuator, so that the first and second legs can be manually moved between the retracted position and the extended position.

Other aspects of this disclosure may relate to a system for a lateral support assembly for a bed that comprises: a base frame including a first side member and a second side member; a first leg rotatably connected to the first side member of the base frame at a foot of the bed; a second leg rotatably connected to the first side member of the base frame at a head of the bed; a first actuator connected to the first leg and the second leg to cause the first and second legs to rotate from a retracted position to an extended position; a third leg rotatably connected to the second side member of the base frame at the foot of the bed; a fourth leg rotatably connected to the second side member of the base frame at the head of the bed; and a second actuator connected to the third leg and the fourth leg to cause the third and fourth legs to rotate from the retracted position to the extended position. Additionally, in the retracted position, the legs may be substantially parallel to the side members of the base frame and in the extended position, the legs may be transverse to the side members of the base frame. The lateral support assembly may further include: a first support connected to the first side member and rotatably connected with the first leg; a second support connected to the first side member rotatably connected with the second leg; a third support connected to the second side member rotatably connected with the third leg; and a fourth support connected to the second side member rotatably connected with the fourth leg. Additionally, the lateral support assembly may further include an emergency release to allow the legs to be disassociated with the actuators, so that the legs can be manually moved between the retracted position and the extended position. The lateral support assembly may further include a plurality of sensors that sense the position of the legs in both the extended position and the retracted position.

Yet other aspects of this disclosure may relate to a patient support system that comprises: a bed base frame assembly with a patient support surface; a plurality of steerable and lockable casters at a foot end and a head end of the bed base frame assembly; and a bed software to control and operate the bed base frame assembly operations. The bed base frame assembly further includes a lateral support assembly. The lateral support assembly may comprise: a base frame including a first side member and a second side member; a first leg and a second leg rotatably connected to the first side member of the base frame; a first actuator connected to the first leg and the second leg, wherein the software operates the first actuator to rotate the first leg and the second leg from the retracted position to the extended position and from the extended position to the retracted position; a third leg and a fourth leg rotatably connected to the second side member of the base frame; and a second actuator connected to the third leg and the fourth leg, wherein the software operates the second actuator to rotate the third leg and the fourth leg from the retracted position to the extended position and from the extended position to the retracted position. Additionally, when the patient support system is put into bariatric mode and a set of width extenders are utilized, the bed software may operate the first and second actuators to rotate the legs to the extended position. When the patient support system is put into tilt mode and the patient support surface is angularly rotated to a substantially vertical position, the bed software may operate the first and second actuators to rotate the legs to the extended position prior to the patient support system being put into tilt mode. When the patient support system includes rotational therapy capabilities, the bed software may operate the first and second actuators to rotate the legs to the extended position. The bed software may ensure that the lateral support assembly is in the extended position before allowing the patient support system to go into a tile mode and a stand mode. The lateral support assembly may further include sensors that sense the position of the legs in both the extended position and the retracted position. Additionally, in the retracted position, the legs may be substantially parallel to the side members of the base frame and in the extended position, the legs may be transverse to the side members of the base frame. The patient support system may further include an emergency release to allow the legs to be disassociated with the actuators, so that the legs can be manually moved between the retracted position and the extended position.

BRIEF DESCRIPTION OF THE DRAWINGS

To understand the present disclosure, it will now be described by way of example, with reference to the accompanying drawings in which embodiments of the disclosures are illustrated and, together with the descriptions below, serve to explain the principles of the disclosure.

Figure 1:
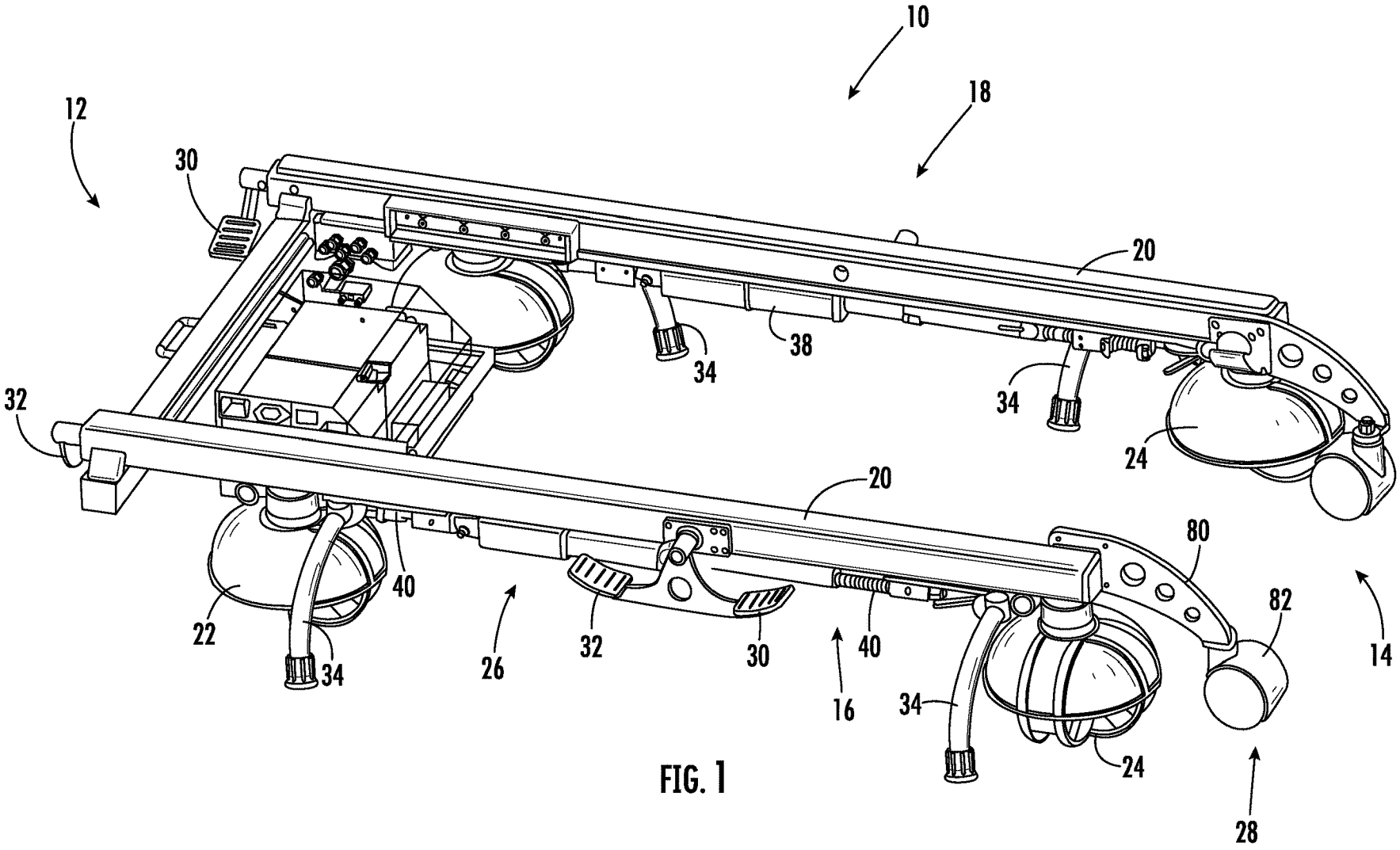
FIG. 1 is a shaded top perspective view of aspects of a bed base assembly frame according to exemplary implementations of the present disclosure.
Figure 2:
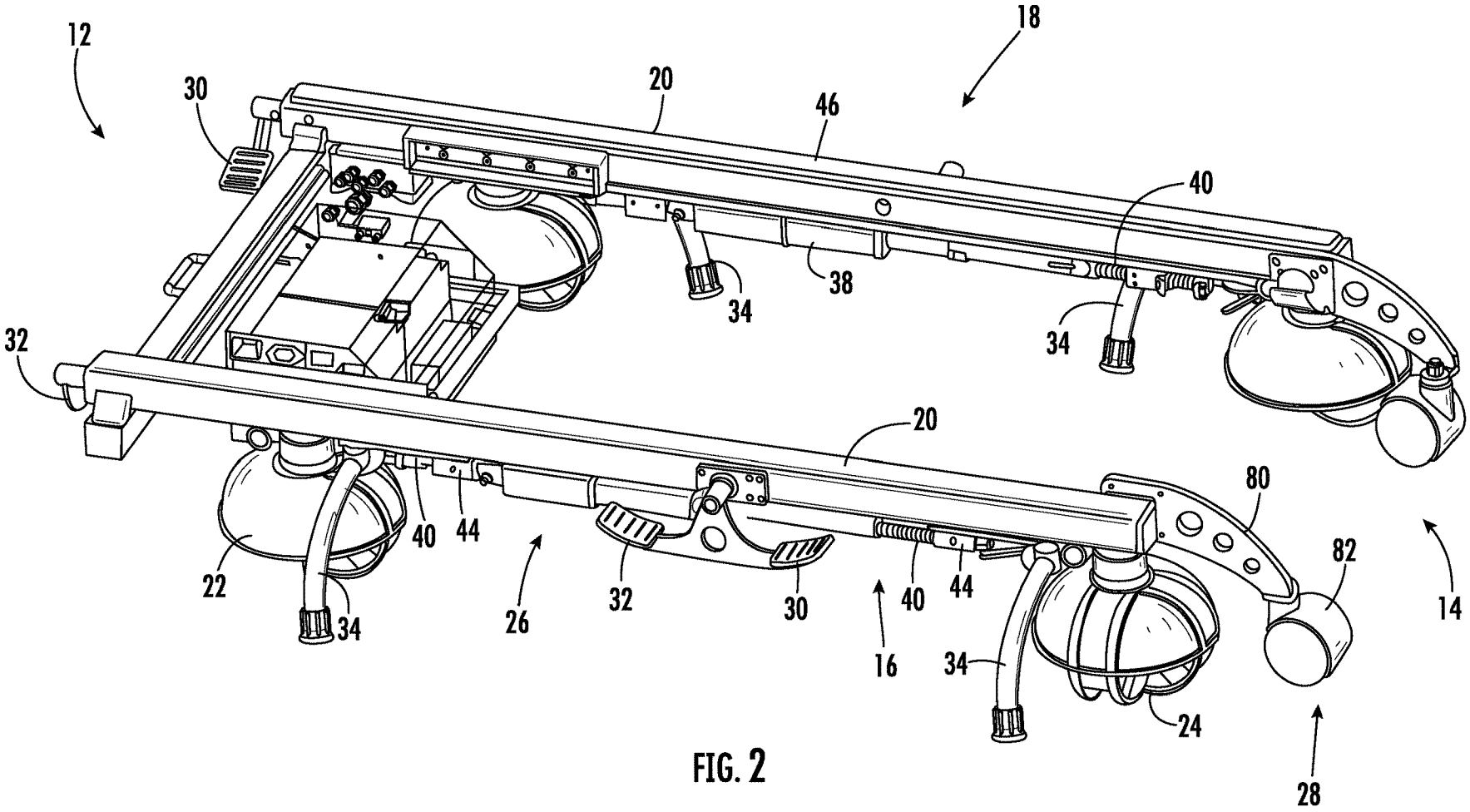
FIG. 2 is a top perspective view of the bed base frame assembly of FIG. 1 in wireframe.
Figure 3:
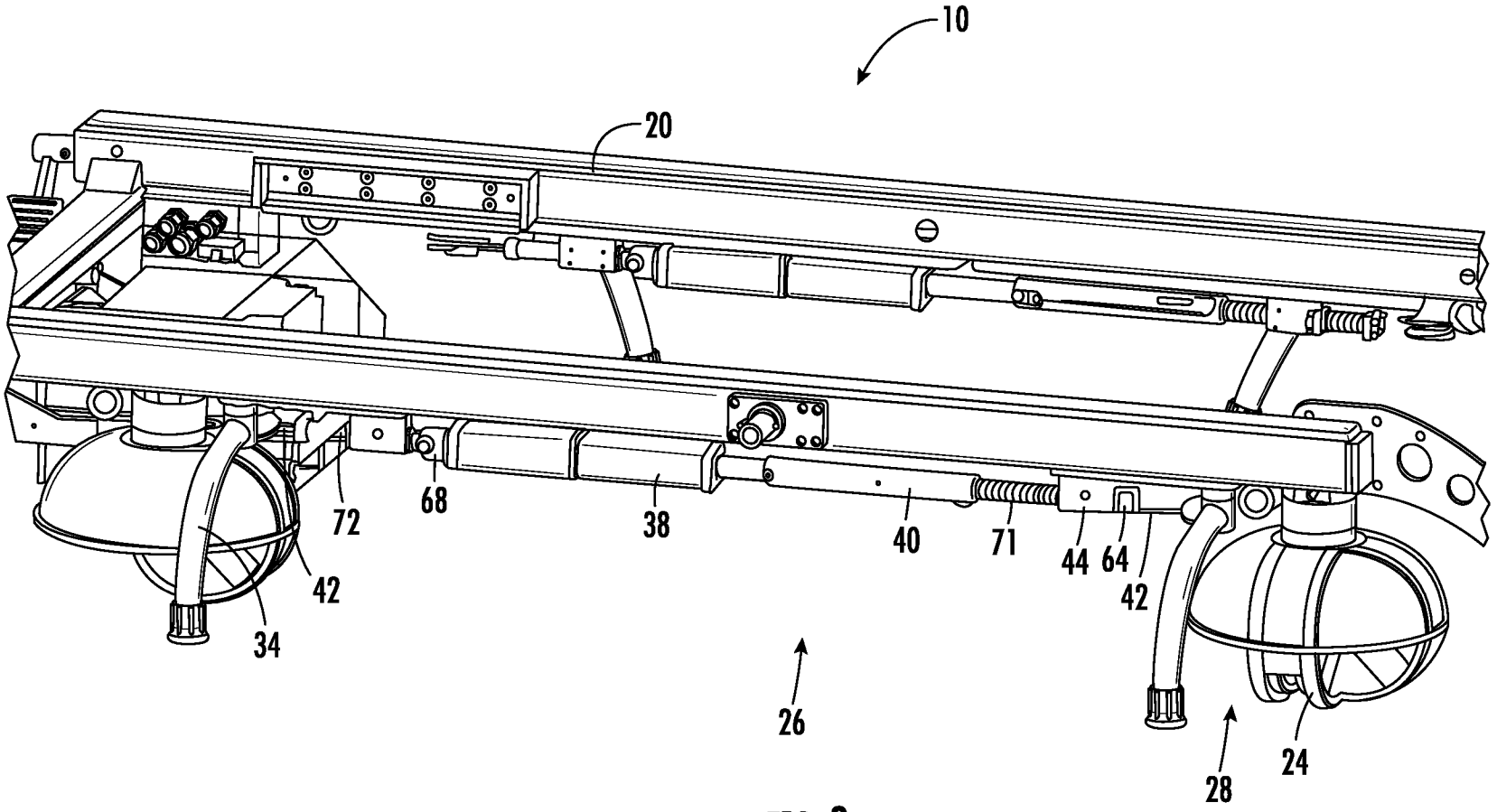
FIG. 3 is a closer top perspective view of the bed base frame assembly of FIG. 2 with one of the brake/steer pedals removed.

Further, it is to be understood that the drawings may represent the scale of different components of one single embodiment; however, the disclosed embodiments are not limited to that particular scale.

DETAILED DESCRIPTION

While the bed base frame assembly discussed herein is susceptible of embodiments in many different forms, there is shown in the drawings, and will herein be described in detail, exemplary implementations with the understanding that the present description is to be considered as an exemplification of the principles of the bed base frame and is not intended to limit the broad aspects of the disclosure to the implementations illustrated.

Referring now to the Figures, there is shown embodiments of a bed base frame assembly 10 that can be used for a variety of beds. The term "bed" herein is used to denote any embodiment of a support for a patient. As such, in different embodiments the "bed" is provided as a traditional bed, a gurney or stretcher, an operating room table or surgical table, a bed that expands and contracts in width, a bed that converts to a chair to allow the patient to exit the bed, a bed that tilts to allow the patient to exit and enter the bed standing, and a variety of combinations thereof. Additionally, each of these variations may have a variety of optional equipment and support surfaces associated therewith.

The bed traditionally has a patient support surface to support the patient. In the standing or tilt embodiment, the bed can be manipulated to angularly rotate the patient support surface to a substantially vertical position, wherein the entire patient support surface is generally in-line and preferably at an angle of about at least 75° from the horizontal, to allow a patient to exit and enter the bed standing. Alternately, the tilt or stand bed may be stopped at any angle between 0° and at least 75° to provide for different therapeutic benefit to the patient. In the expanding width bed configuration the bed is manipulated to convert to a wider patient support surface at various sections of the bed. The width of the expanding width bed may be narrowed, however, to that of a conventional hospital bed to provide for ease of mobility of the bed. Additionally, in one embodiment the bed is a bariatric bed, meaning it is provided to support morbidly obese patients. In the chair bed embodiment the bed is manipulated to achieve both a conventional bed position having a generally horizontal patient support or sleeping surface upon which a user lies in a supine position, and a sitting position wherein the foot deck of the bed is provided in a generally vertical position such that the user's feet can be positioned on or adjacent the floor and the back of the user is supported by a raised back support.

Each bed generally requires a base frame assembly 10, as shown in FIG. 1, which supports additional bed frame assemblies, such as an intermediate frame assembly, a weigh frame assembly, and a patient support assembly (none of the additional frame assemblies are shown in the figures). In various embodiments, the base frame assembly 10 typically has a plurality of actuators (not shown) that raise and lower the intermediate frame assembly. The weigh frame assembly is preferably connected to the intermediate frame assembly, and the patient support assembly is preferably connected to the weigh frame assembly. Generally, the weigh frame assembly may be coupled to the intermediate frame assembly by a plurality of load cells or load beams.

In an embodiment where the bed can tilt to provide standing access and egress, a tilting frame assembly (not shown) is also provided. The tilting frame assembly may be supported by the weigh frame assembly. The tilting frame assembly may preferably be connected with a lift actuator to the intermediate frame assembly to provide for lifting of the tilting frame assembly. Further, in a bed that employs a tilting frame assembly, the tilting frame assembly is preferably connected to the weigh frame assembly, but the tilting frame assembly can be partially removed when in tilt/stand mode. In a bed that does not employ a tilting frame assembly, the patient support assembly is coupled to the weigh frame assembly by a plurality of actuators that raise and lower the different sections of the bed (i.e., a head section, an intermediate or seat section, and a foot section), typically at various angular orientations.

The bed and associated bed base frame assembly 10 has a head end 12, a foot end 14 opposing the head end 12, a first side 16, and a second side 18 opposing the first side 16. The term "head end" is used to denote the end of any referred to object that is positioned nearest the head end 12 of the bed base frame assembly 10, and the term "foot end" is used to denote the end of any referred to object that is positioned nearest the foot end 14 of the bed base frame assembly 10.

In one embodiment, the base frame assembly 10 of the bed generally comprises a base frame 20, a plurality of steerable and lockable casters 22, 24, a lateral support assembly 26 at each of the first and second sides of the base frame assembly 10, and an in-line support assembly 28 at the foot end 14 of the base frame assembly 10. The casters include a pair of casters 22 at the head end 12 of the base frame assembly 10, and a pair of casters 24 at the foot end 14 of the base frame assembly 10. In the tilt or stand-up bed configuration of the bed frame assembly 10, heavy duty casters are preferred.

A preferred embodiment of the base frame assembly 10 also preferably comprises a central brake and steer system. In one embodiment, one aspect of the brake and steer system is that it includes a brake pedal 30 and a steer pedal 32 at the head end 12 of the base frame assembly 10. The brake and steer pedals 30, 32 located near the head end 12 of the base frame assembly 10 are arranged in such a way that the operator who is moving the bed can easily activate the pedals without moving to the sides of the bed. When not transporting the bed, there are two central brake/steer systems located at the middle of each bed side allowing the operator to easily position the casters 22, 24 to the steer or brake positions from the side of the bed. Accordingly, in summary, in a preferred embodiment, one brake pedal 30 and one steering pedal 32 are provided at the head end 12 of the base frame assembly 10, and one brake pedal 30 and one steering pedal 32 are provided on each side of the base frame assembly 10. In one embodiment, all six of the brake and steer pedals 30, 32 are mechanically linked together with a series of mechanical linkages that may extend within the tubing of the base frame 20. As a result, the operator only needs to activate one of the brake/steer pedals 30, 32 to set the entire brake and steer system in either brake mode or steer mode because all of the brake/steer pedals and all of the casters are mechanically linked. Alternately, rather than employing a manual or mechanically linked system to lock/unlock each of the casters 22, 24, the bed may employ an automatic mode to lock/unlock each of the casters 22, 24. In the automatic mode rather than relying on mechanical linkages to lock/unlock each of the casters 22, 24, the bed has an automatic system (not shown) that powers separate actuators for each caster 22, 24 to separately lock/unlock each of the casters 22, 24 as desired. Further, for the automatic mode, a plurality of sensors or switches may be provided at each of the brake and steer pedals 30, 32. The sensors/switches are preferably electrically connected to each of the actuators at each of the casters 22, 24 to separately lock/unlock each of the casters 22, 24. Additionally, when the bed includes an automatic mode to lock/unlock each of the casters 22, 24, the bed may also include an override switch (not shown) at the head end 12 of the base frame assembly 10 to transition the brake and steer system between the automatic mode (using sensors/switches at the pedals 30, 32 to operate actuators at the casters 22, 24 to lock/unlock each caster) and the manual mode (using mechanical linkages to mechanically connect each of the pedals 30, 32 with the casters 22, 24 to lock/unlock each caster).

There are three modes to the brake and steer system: (1) brake mode; (2) neutral mode; and, (3) steer mode. The brake mode is set by fully engaging/pressing any of the three brake pedals 30. When in the brake mode all four casters 22, 24 will be simultaneously locked to prevent the bed from moving. The neutral mode is set by positioning any of the brake/steer pedals 30, 32 to the middle position, which is the neutral position. In the neutral position all four of the casters 22, 24 are placed in the fully rotatable and unlocked orientation. The steer mode is set by fully engaging/pressing any of the three steer pedals 32. In the steer position, one or more of the casters at the foot end 14 of the bed will lock in the forward position, through a mechanical linkage connected from the steer pedals 32 to the caster(s) at the foot end 14 of the base frame assembly 10 to assist in overall steering capabilities of the bed during transport.

The brake and steer system is supported by a brake or caster lock function in the bed's software that ensures that the brake system is in the lock mode before allowing the bed to go into tilt or stand mode. For example, if the user attempts to place the bed into tilt/stand mode and the caster/brake lock is not engaged, the software will provide an alarm and will preclude the user from actuating tilt/stand mode. Once the bed is placed into brake lock mode (i.e., all casters are locked either mechanically or with actuators) the software will disarm the alarm and allow the user to place the bed in tilt/stand mode. Further, once in tilt/stand mode, the software will not allow the brake lock mode to be disengaged until the bed is back in the full horizontal position. The brake and steer system uses either a solenoid or actuator that is operated by the software to maintain the brake lock in brake mode during tilt/stand operations. In the automatic mode, the brake and steer system will maintain the actuators in the lock mode during tilt/stand operations to keep each caster locked. The caster lock function locks the casters to prevent any unexpected movement of the bed during tilt/stand mode.

In a preferred embodiment, as explained herein, the lateral support assemblies 26 are operated by the bed's software, similar to the brake and steer system in certain modes.

Referring to the figures, each side 16, 18 of the bed has a separate lateral support assembly 26. As shown in FIGS. 3-6, each of the lateral support assemblies 26 may generally include first and second legs 34, a support 36 for each leg 34, an actuator 38, extensions 40 connected to each end of the actuator 38, and linkages 42 connecting the extensions 40 to the legs 34. The lateral support assembly 26 preferably also includes lateral supports 44 for the actuator 38. As explained herein, in one embodiment the actuators 38 are supported by the lateral supports 44 via the extensions 40. Accordingly, in one embodiment, the actuators 38 are not fixed laterally, but instead can traverse laterally based on the actuation stroke and stops between the extensions 40 and the lateral supports 44.

The lateral support assembly 26 preferably has two positions, an extended or use position, shown by the position of the legs 34 at the first side 16 of the base frame assembly 10 in FIGS. 1-3 and 6-11, and the retracted position, shown by the position of the legs 34 at the second side 18 of the base frame assembly 10 in FIGS. 1-3 and 6-11. In the use position the legs 34 are preferably transverse to the side frame members 46 of the based frame 20, and in the retracted position the legs 34 are preferably generally in-line or substantially parallel to the side frame members 46 of the base frame 20. As explained herein, the legs 34 preferably rotate from the retracted position to the use position due to the rotational connection between the legs 34 and their respective supports 36, and the action of the actuator 38. The legs 34 may rotate either clockwise or counter-clockwise from the retracted position to the use position and from the use position to the retracted position in accordance with aspects of this invention.

Figure 9:
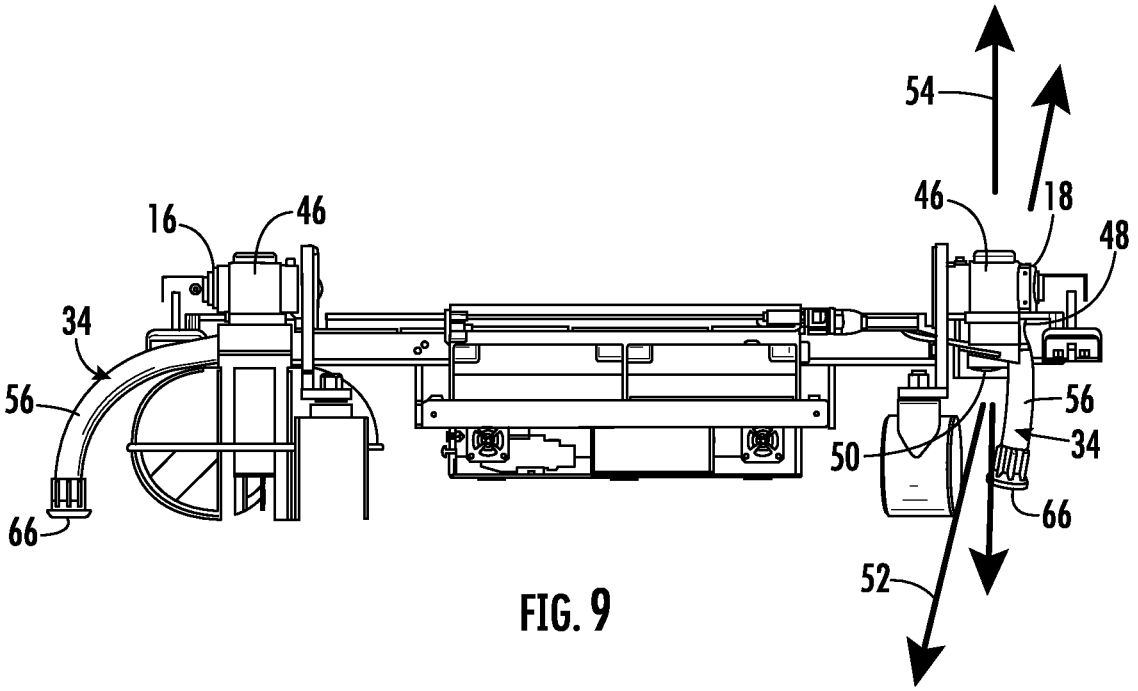
FIG. 9 is a rear end elevation view of the bed base frame assembly of FIG. 2 taken from the foot end of the bed.

In one embodiment the support 36 for each leg 34 comprises a flange portion 48 and a shaft portion 50. As shown in FIG. 9, the shaft portion 50 is angled inwardly toward the opposing side of the base frame 20, such that the longitudinal axis 52 of the shaft portion 50 of the support 36 is transverse to the vertical axis 54 extending through the side frame members 46 of the base frame 20.

Each leg 34 preferably has an extension portion 56, which may be a curved tubular extension portion 56 as shown in the figures, a receiving portion 58 that rotatingly engages the shaft portion 50 of the support 36, and a flange portion 60 to connect the legs 34 to a first end 62 of the linkages 42. In a preferred embodiment, the flange portions 60 of the legs 34 are pivotally connected to the linkages 42.

The second end 64 of the linkages 42 are pivotally connected to the one of the extensions 40 from the actuator 38. Accordingly, the flange portion 60, linkage 42 and extension 40 forms a three-bar linkage mechanism whereby linear motion of the extension 40 is converted into rotational motion of the leg 34.

Figure 10:
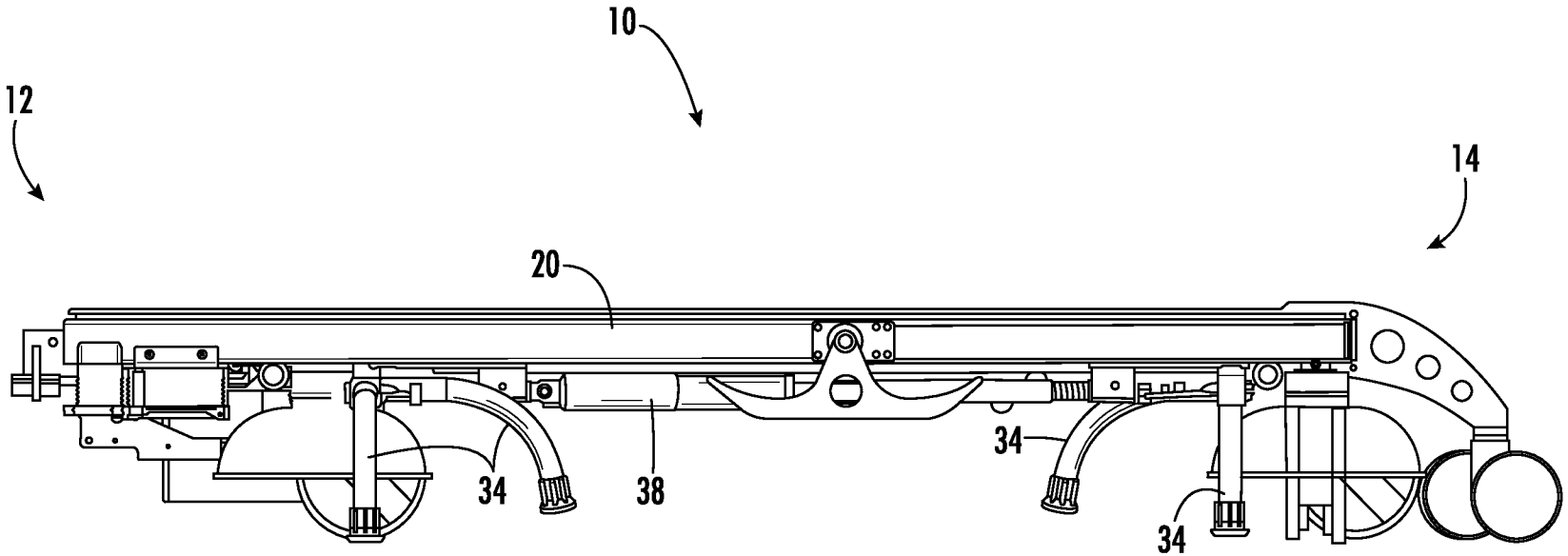
FIG. 10 is a first side elevation view of the bed base frame assembly of FIG. 2.
Figure 11:
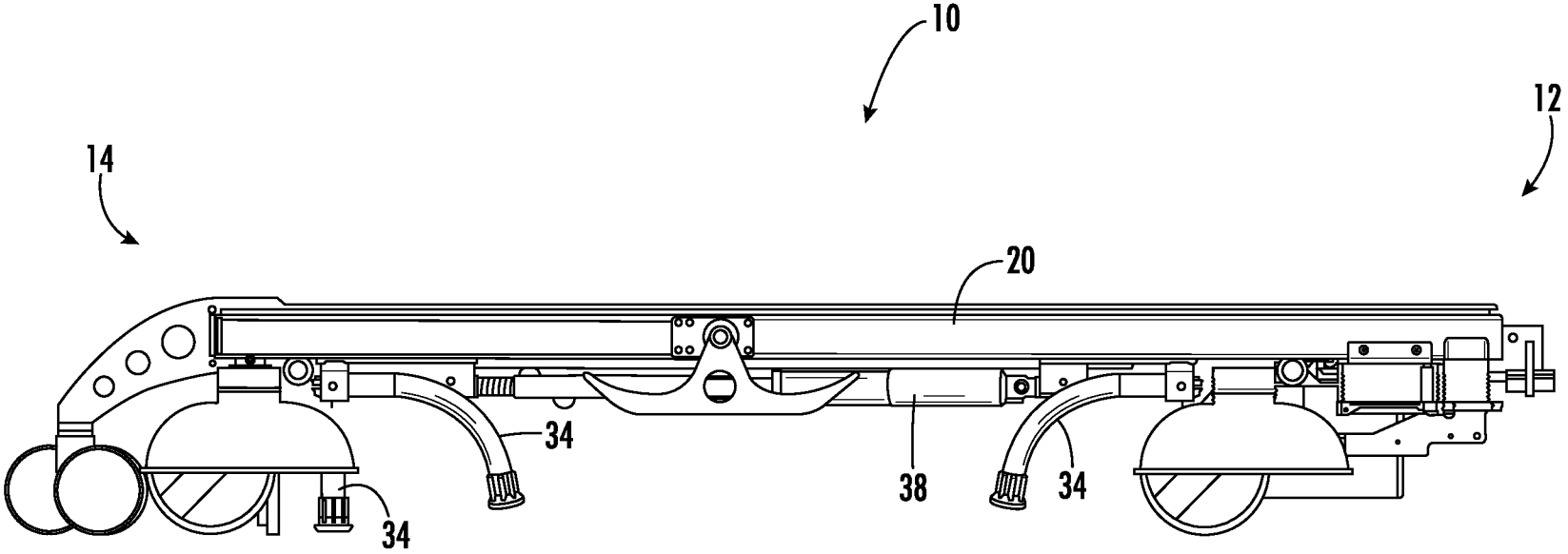
FIG. 11 is a second side elevation view of the bed base frame assembly of FIG. 2.

As shown in FIGS. 9-11, in one embodiment the end 66 of the legs 34 of the lateral support assembly 26 is higher off the floor (i.e., the distance from the floor to the bottom of the end of the leg is greater) when the legs 34 are in the retracted position (i.e., the legs 34 at the second side 18 of the base frame assembly 10), than when the legs 34 are in the extended or use position (i.e., the legs 34 at the first side 16 of the base frame assembly 10). This is because, as explained above, in one embodiment, the supports 36 to which the legs 34 are rotationally connected have a shaft portion 50 that is transverse to the vertical axis 54 extending through the side frame members 46 of the base frame 20. Accordingly, as the leg 34 rotates from the retracted position, generally parallel to the side frame members 46 of the base frame 20, to the use position, generally transverse or perpendicular to the side frame members 46 of the base frame 20, the end 66 of the legs 34 moves closer to the ground.

Figure 4:
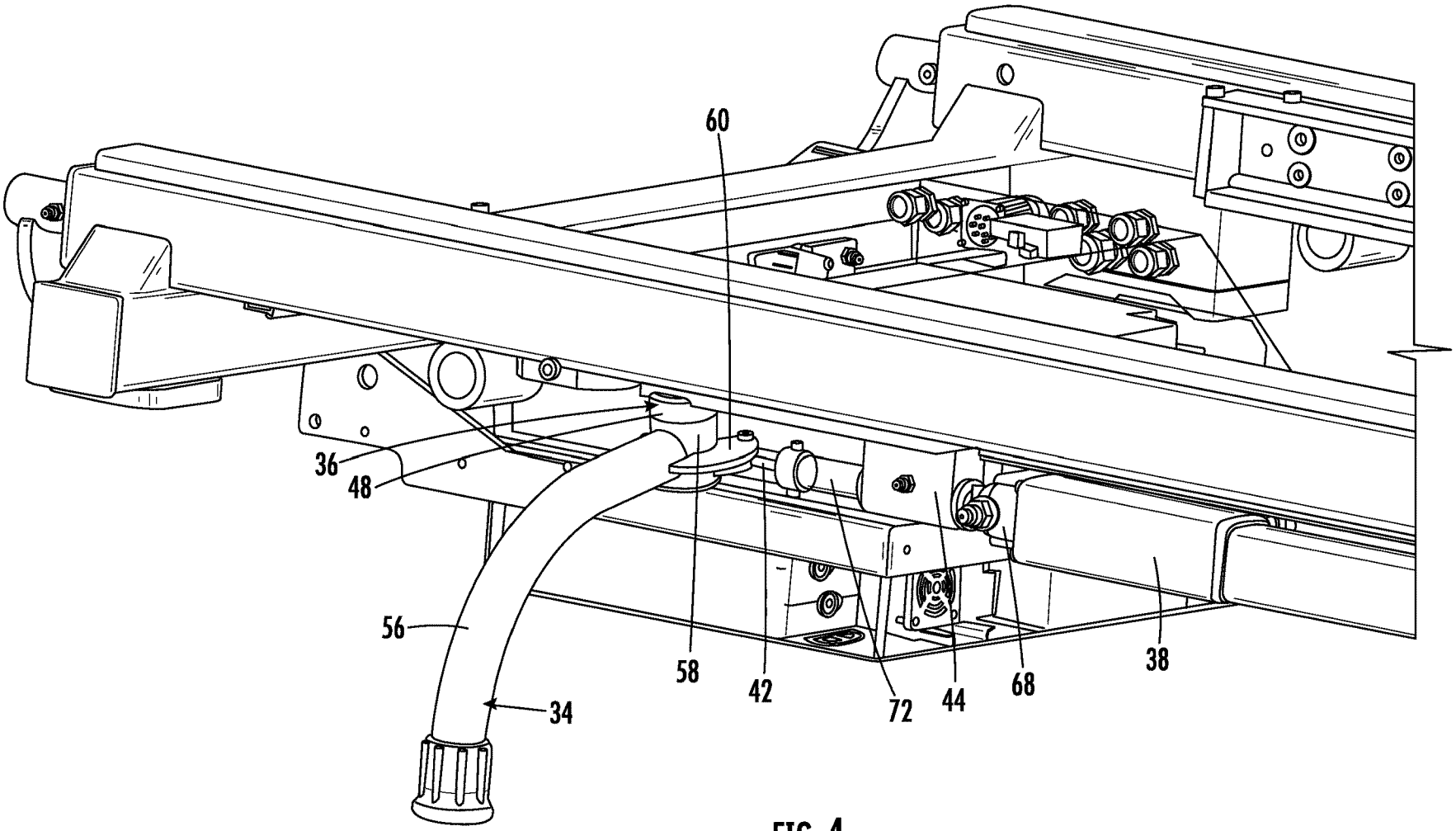
FIG. 4 is a closer top perspective view of one of the extended lateral legs of the bed base frame assembly of FIG. 2.
Figure 5:
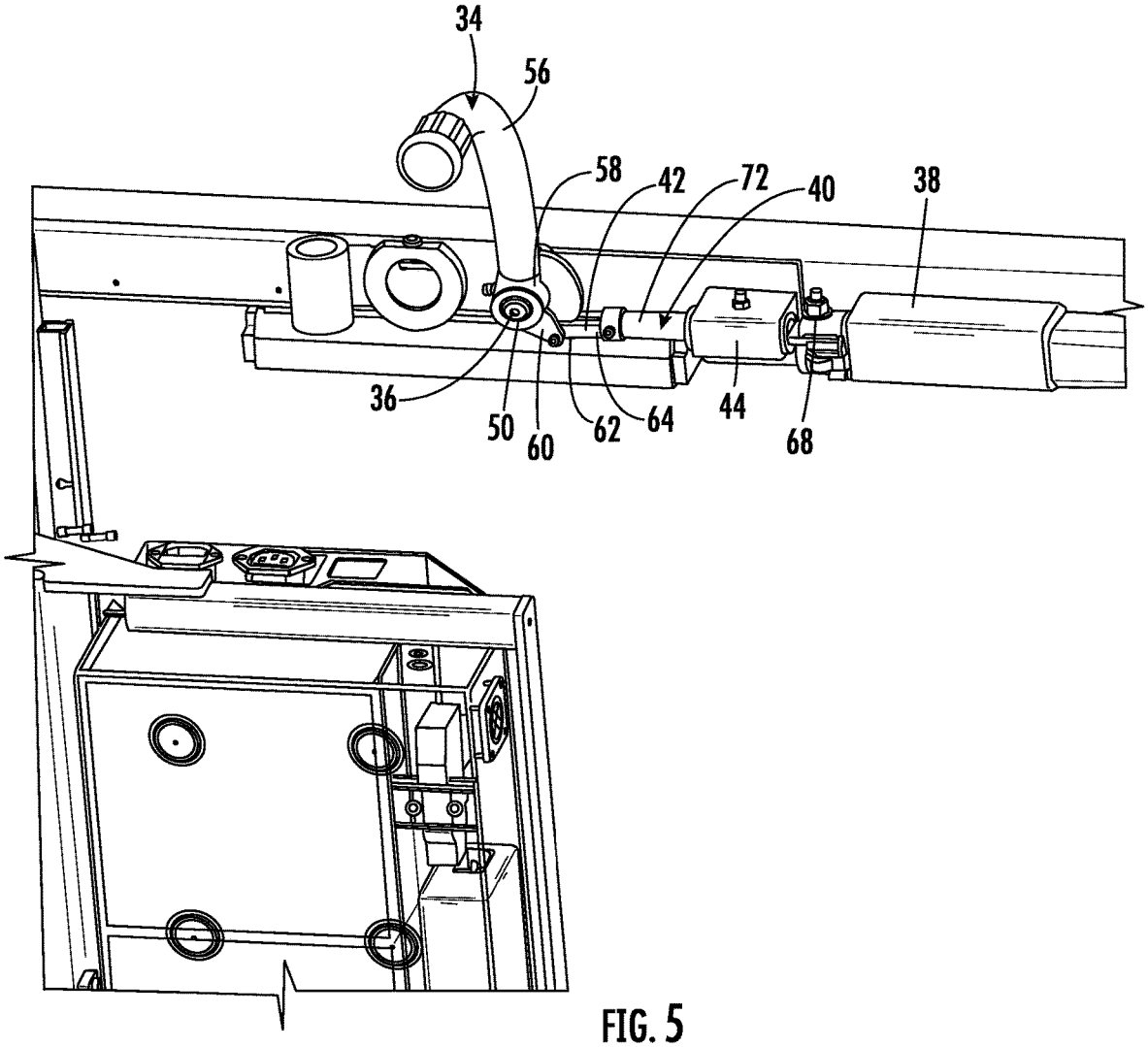
FIG. 5 is a closer bottom perspective view of one of the extended lateral legs of the bed base frame assembly of FIG. 2.
Figure 6:
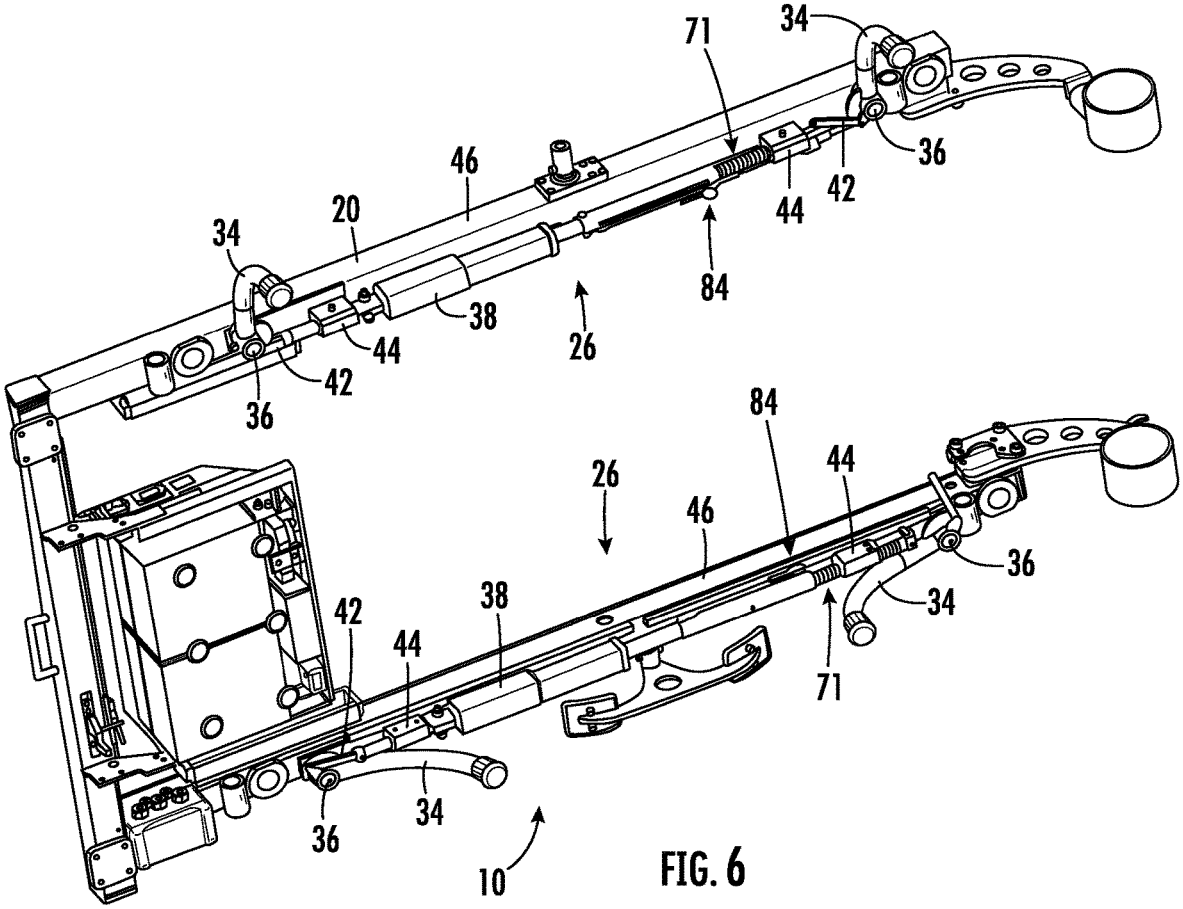
FIG. 6 is a bottom perspective view of the bed base frame assembly of FIG. 3.

Referring to FIGS. 2-7, the lateral support assembly 26 also utilizes two lateral supports 44 to support each actuator 38. Preferably, one lateral support 44 is connected to the bottom of the side frame member 46 of the base frame 20 on one side of the actuator 38, and another lateral support 44 is connected to the bottom of the side frame member 46 of the base frame 20 on the other side of the actuator 38. In a preferred embodiment the actuator 38 is a linear actuator. Accordingly, in one embodiment one end of the linear actuator 38 has a receiver 68 and the other end has an actuator shaft 70 that transitions outwardly and inwardly from the linear actuator 38. The actuator shaft 70 may be a lead screw in an alternate embodiment. Preferably, the actuator shaft 70 has a set distance that it moves inwardly and outwardly, referred to as the stroke. The stroke is set such that at one end of the stroke the two legs 34 are fully retracted in the retracted position, and at the other end of the stroke the two legs are fully extended in the use position. Additionally, the actuator shaft 70 may alternately have a spring 71 associated therewith toward a distal end thereof, as shown in FIG. 6. The spring 71 may assist the leg 34 at the foot end 14 swing out prior to the leg 34 at the head end 12, and similarly, the spring 71 may assist in having the leg 34 at the foot end 14 retract after the leg 34 at the head end 12.

As shown in FIGS. 4 and 5, an extension shaft 72 may be fixedly connected at one end to the receiver 68 of the actuator 38, and at the other end to the second end 64 of the linkage 42. The extension shaft 72 that connects the actuator 38 to one of the linkages 42 is referred to as one of the extensions 40. The extension shaft 72 is supported by bushings in one of the lateral supports 44, but the extension shaft 72 is preferably able to slide laterally within the lateral support 44, but only if and when the actuator 38 moves as the extension shaft 72 is fixed in place to the actuator 38. The movement of this extension 40 laterally operates to rotate the leg 34 closest to the foot end 14 of the base frame 20.

The other extension 40 of the actuator 38 is the actuator shaft 70 or lead screw 70 that extends in and out of the actuator 38. The end of the actuator shaft 70 is connected to the second end 64 of the other linkage 42. The actuator shaft 70 is supported by the other lateral support 44, but the actuator shaft 70 is similarly able to move laterally within the lateral support 44. The movement of this extension 40 laterally operates to rotate the leg 34 closest to the head end 12 of the base frame 20. Unlike the extension shaft 72 which has no movement relative to the actuator 38 and which only moves with the actuator 38, all movement of the actuator shaft 70 is movement relative to the actuator 38 (i.e., in or out of the actuator 38).

The lateral support assembly 26 provides additional lateral support for the bed. Such additional lateral support may be needed under numerous circumstances. For example, if the bed is put into bariatric mode, meaning width extenders are utilized then additional lateral support may be needed. Similarly, if the bed is put into tilt mode and the patient support surface is tilted upwardly to the vertical, additional lateral support may be needed as the center of gravity of the patient is raised. Further, if the bed has rotational therapy capabilities, the additional lateral support may be beneficial, especially with bariatric beds.

Figure 7:
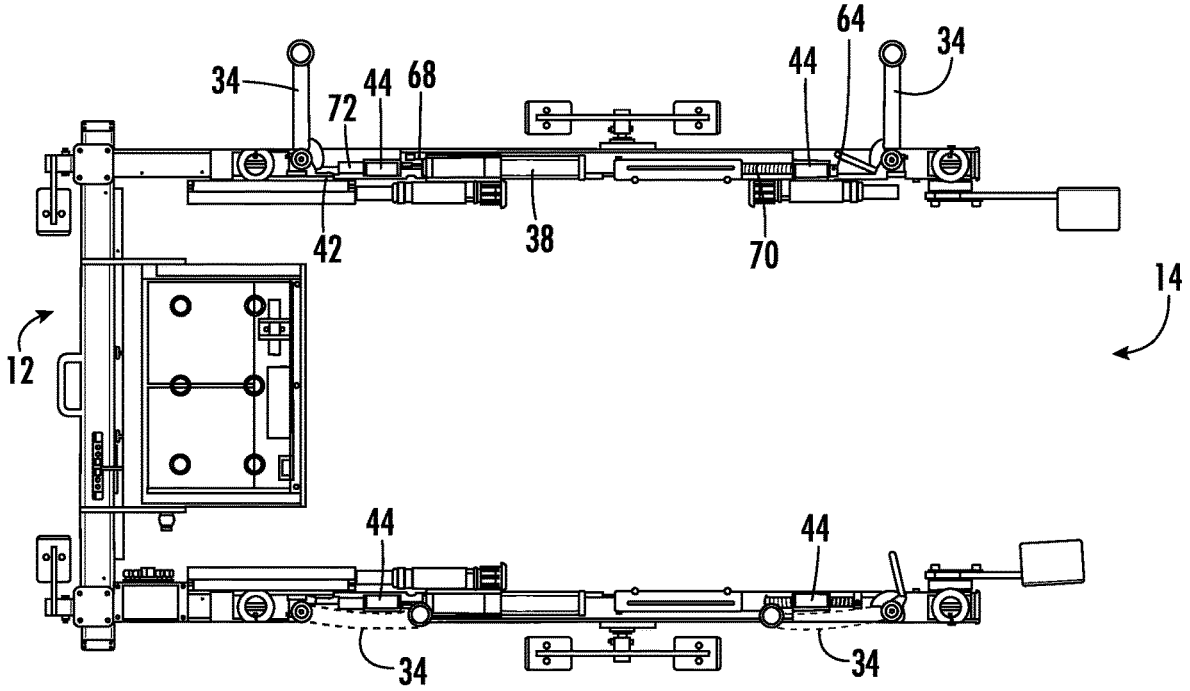
FIG. 7 is a bottom plan view of the bed base frame assembly of FIG. 2.
Figure 8:
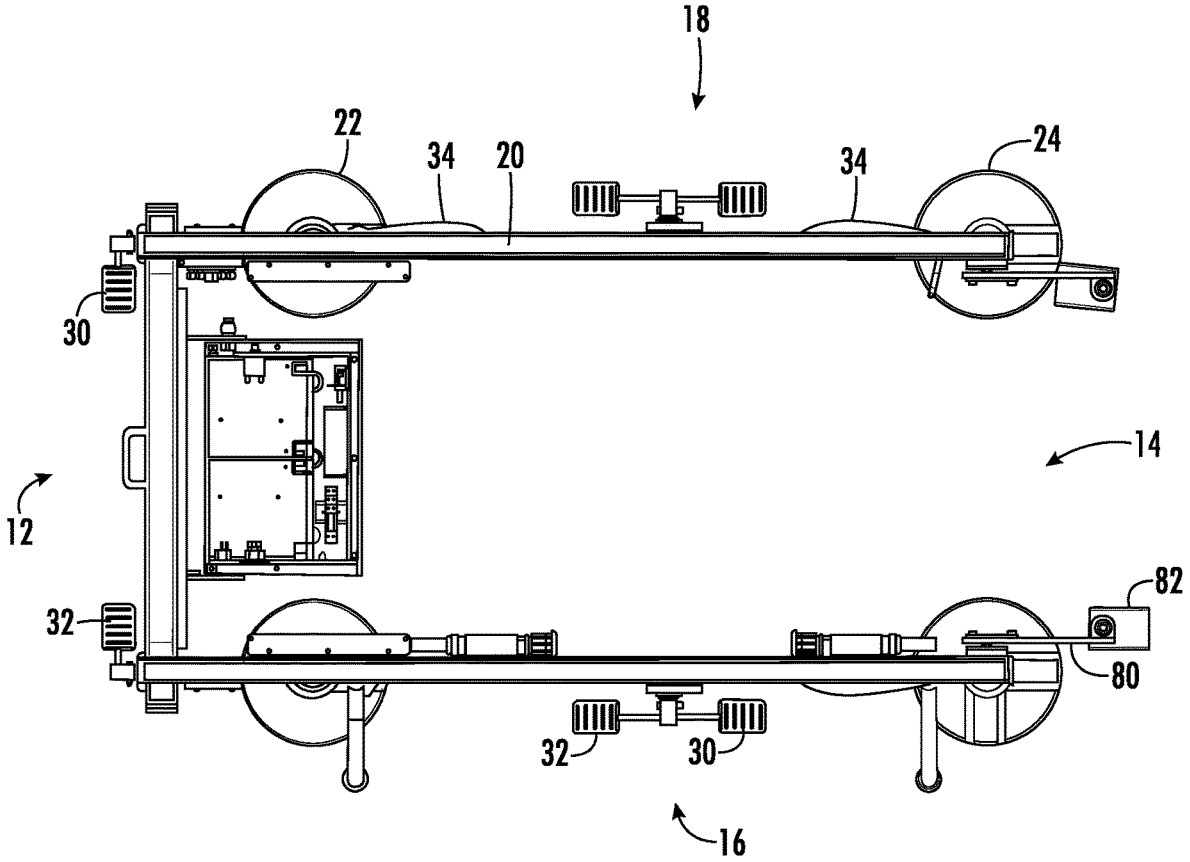
FIG. 8 is a top plan view of the bed base frame assembly of FIG. 2.

As explained above, there are two modes to the lateral support assembly 26: (1) retracted mode, and (2) use mode. In the retracted mode, the software of the bed will operate the two actuators 38 to transition both legs 34 on each side of the base frame 20 to the retracted position. Referring to FIGS. 7 and 8, the two legs 34 on the second side 18 of the base frame 20 are in the retracted position. In the use mode, the software of the bed will operate the two actuators 38 to transition both legs 34 on each side of the base frame 20 to the use or extended position. Referring to FIGS. 7 and 8, the two legs 34 on the first side 16 of the base frame 20 are in the use or extended position. It is understood that the figures illustrate one set of legs in the use position and one set of legs in the extended position for illustrative and teaching purposes only. In actual use all legs will be either in the use or retracted positions generally together.

The lateral support assembly 26 is generally controlled by a function in the bed's software that ensures that the lateral support system is in the use or extended mode before allowing the bed to go into some other configuration, such as tilt or stand mode. For example, if the user attempts to place the bed into tilt/stand mode and the lateral support system is not in the use mode, the software will preclude the tilt/stand mode from being utilized. Alternately, if the user attempts to place the bed into tilt/stand mode and the lateral support system is not in the use mode, the software will first place the lateral support system in the use mode before allowing the user to begin the tilt/stand process. Once the bed is placed into tilt/mode the software will maintain the legs in the use position until the tilt/stand mode is completed.

In use, when the system wants to transition the lateral support assembly 26 from the retracted mode to the use mode, the bed software sends a signal to each of the two actuators 38. In one embodiment, the two actuators 38 will begin to retract their actuator shaft 70 which causes the extension 40 and linkage 42 to move linearly toward the actuator 38 and which further causes the leg 34 closest to the head end 12 of the base frame 20 to rotate from the retracted position to the use position. When the leg 34 closest to the head end 12 of the base frame 20 is fully in the use position, a portion of the extension 40 will contact an edge of the lateral support 44. However, the actuator 38 continues to retract the actuator shaft 70, thereby causing the actuator 38 to move toward the head end 12 of the base frame 20. When the actuator 38 moves toward the head end 12 of the base frame 20 the extension shaft 72 that is fixed to the actuator 38 also moves toward the head end 12 of the base frame 20, causing the linkage 42 connected to the foot end 14 leg 34 to rotate from the retracted position to the use position. When the leg 34 closest to the foot end 14 of the base frame 20 is fully in the use position the actuator 38 will stop further movement. As one can understand based on the figures, the leg 34 at the head end 12 of the bed will rotate outward and toward the head end 12 of the base frame 20, and the leg 34 at the foot end 14 of the bed will rotate outward and toward the foot end 14 of the base frame 20. Further, as the legs 34 rotate from the retracted to the use position the ends 66 of the legs 34 will move toward the ground. This allows the end 66 of the legs 34 to be raised in the retracted position and not be a pinch point, but also allows the end 66 of the legs 34 to be closer to the ground in the use position to prevent tipping of the bed.

To retract the legs 34 from the use position to the retracted position, the bed software sends a signal to each of the two actuators 38. In one embodiment, the two actuators 38 will begin to extend their actuator shaft 70 which initially causes the actuator 38 to move linearly toward the foot end 14 of the base frame 2, and which further causes the extension shaft 72 that is fixed to the actuator 38 to also move toward the foot end 14 of the base frame 20, causing the linkage 42 connected to the foot end 14 leg 34 to rotate from the use position to the retracted position. When the leg 34 closest to the foot end 14 of the base frame 20 is fully in the retracted position, a portion of the actuator 38 will contact an inner edge of the lateral support 44 preventing the actuator 38 from moving. When the actuator 38 cannot move and the actuator shaft 70 is still being extended, the actuator shaft 70 will cause the linkage 42 connected head end 12 leg 34 to rotate from the use position to the retracted position. When the leg 34 closest to the head end 12 of the base frame 20 is fully in the retracted position the actuator 38 will stop further movement. As one can understand based on the figures, the leg 34 at the head end 12 of the bed will rotate inwardly and toward the foot end 14 of the base frame 20, and the leg 34 at the foot end 14 of the bed will rotate inwardly and toward the head end 12 of the base frame 20 during retraction. Further, as the legs 34 rotate from the use position to the retracted position the ends 66 of the legs 34 will move away from the ground. This allows the end 66 of the legs 34 to be raised in the retracted position and not be a pinch point.

In another embodiment, the lateral support assembly 26 may include a plurality of sensors or switches that may be provided at each of the legs 34 and/or supports 36. The sensors/switches are preferably electrically connected to each of the actuators 38 at each of the legs 34 and/or supports 36 to separately lock/unlock each of the legs 34 and/or supports 36. The sensors/switches may be utilized to lock/unlock the legs 34 from moving to the retracted position or extended position based on the configuration of the bed. For example, if the user attempts to place the bed into tilt/stand mode, the sensors/switches will confirm that the lateral support assembly 26 and the legs 34 are in the extended position, and the bed software may preclude the tilt/stand mode from being utilized until the lateral support assembly 26 and the legs 34 are in the extended position. Alternately, if the user attempts to move the bed, the sensors/switches will confirm that the lateral support assembly 26 and the legs 34 are in the retracted position, and the bed software may preclude movement of the bed until the lateral support assembly 26 and the legs 34 are in the retracted position.

While the embodiments in the figures show four separate legs 34 as part of the lateral support assembly 26, additional legs 34 may be utilized without departing from this invention. For example, the lateral support assembly 26 may include six legs 34 or eight legs 34 without departing from this invention.

The lateral support assembly 26 may also have an emergency release to allow the legs 34 to be disassociated from the actuator 38. Specifically, as best shown in FIG. 6, an emergency pin 84 may be provided that joins the legs 34 to the extensions 40. By removing the pin 84 the legs 34 can be manually moved between the retracted and use positions, and they can be repositioned in any position desired by the user.

The in-line support assembly 28 at the foot end 14 of the base frame assembly 10 is provided to provide support from forward tipping of the bed, and also to provide a support surface outside of the casters 24 at the foot end 14 of the base frame assembly 10 during periods of movement of the bed. In one embodiment, the in-line support assembly 28 comprises a bracket 80 connected to each side frame member 46 of the base frame 20 at the foot end 14 of the base frame 20, with a wheel 82 connected to the end of the bracket 80 distal the base frame 20. The in-line support assembly 28 and the bracket 80 may be fixedly attached to each side frame member 46 of the base frame 20. In another embodiment, the in-line support assembly 28 and the bracket 80 may be rotatedly-attached to the side frame members 46 of the base frame 20, wherein the bracket 80 rotates from a retracted position to an extended position. In another embodiment, the in-line support assembly 28 and the bracket 80 may extend from the side frame members 46 of the base frame 20 from a retracted position to an extended position.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

We claim:

1. A hospital bed comprising:

a frame, the frame includes a first side member;

a patient deck;

a plurality of side rails;

a lift mechanism connected to the patient deck and the frame;

a plurality of casters connected to the frame;

a first leg connected to the first side member of the frame;

the first leg has an extended position, the extended position is laterally outward to the first side member.

2. The hospital bed as in claim 1 wherein in the extended position the first leg is at a first extended angle to the first side member, the first extended angle is between 1 degree to 179 degrees relative to the first side member.

3. The hospital bed as in claim 2 wherein the first extended angle is about 90 degrees relative to the first side member.

4. The hospital bed as in claim 1 wherein the first leg has a retracted position.

5. The hospital bed as in claim 4 wherein in the retracted position the first leg extends laterally outward less than when the first leg is in the extended position.

6. The hospital bed as in claim 4 wherein in the retracted position, the first leg is substantially parallel to the first side member.

7. The hospital bed as in claim 4 wherein the first leg is rotatably connected to the first side member.

8. The hospital bed as in claim 4 wherein the first leg is configured to be manually moved from the extended position to the retracted position.

9. The hospital bed as in claim 4 wherein the first leg is configured to be automatically moved from the extended position to the retracted position.

10. The hospital bed as in claim 9 further including an actuator, the actuator moves the first leg from the extended position to the retracted position.

11. The hospital bed as in claim 10 further including a release to allow the first leg to be disassociated with the actuator.

12. The hospital bed as in claim 4 wherein the first leg is automatically controlled.

13. The hospital bed as in claim 1 wherein the first leg must be in the extended position in order for the patient deck to be angularly rotated relative to the horizontal.

14. The hospital bed as in claim 1 wherein the first leg is configured to be automatically moved to the extended position prior to the patient deck being angularly rotated relative to the horizontal.

15. The hospital bed as in claim 1, wherein the first leg includes a shaft portion, the shaft portion angled inwardly toward an opposing side of the frame such that a longitudinal axis of the shaft portion is transverse to a vertical axis extending through the first side member of the frame.

16. The hospital bed as in claim 1 wherein the frame includes a second side member, a second leg connected to the second side member of the frame, the second leg has an extended position, the extended position of the second leg is laterally outward to the second side member.

17. The hospital bed as in claim 16 wherein in the extended position the second leg is at a second extended angle to the second side member, the second extended angle is between 1 degree to 179 degrees relative to the second side member.

18. The hospital bed as in claim 17 wherein the second extended angle is about 90 degrees relative to the first side member.

19. The hospital bed as in claim 16 wherein the second leg has a retracted position.

20. The hospital bed as in claim 19 wherein in the retracted position the second leg extends laterally outward less than when the second leg is in the extended position.

21. The hospital bed as in claim 19 wherein in the retracted position, the second leg is substantially parallel to the second side member.

22. The hospital bed as in claim 16 wherein the second leg is rotatably connected to the second side member.

23. The hospital bed as in claim 19 wherein the second leg is configured to be manually moved from the extended position to the retracted position.

24. The hospital bed as in claim 19 wherein the second leg is configured to be automatically moved from the extended position to the retracted position.

25. The hospital bed as in claim 19 further including a second actuator, the second actuator moves the second leg from the extended position to the retracted position.

26. The hospital bed as in claim 25 further including a release to allow the second leg to be disassociated with the second actuator.

27. The hospital bed as in claim 19 wherein the second leg is automatically controlled.

28. The hospital bed as in claim 16 wherein the first leg must be in the extended position and the second leg must be in the extended position in order for the patient deck to be angularly rotated relative to the horizontal.

29. The hospital bed as in claim 16 wherein the first leg is configured to be automatically moved to the extended position and the second leg is configured to be automatically moved to the extended position of the second leg prior to the patient deck being angularly rotated relative to the horizontal.

30. The hospital bed as in claim 16 wherein a third leg is connected to the first side member of the frame, the third leg has an extended position, the extended position of the third leg is laterally outward to the first side member, a fourth leg is connected to the second side member of the frame, the fourth leg has an extended position, the extended position of the fourth leg is laterally outward to the second side member.

31. The hospital bed of claim 1 wherein the lift mechanism includes a tilt frame connected to the frame and connected to and supporting the patient deck, the tilt frame being rotatable to place the patient deck in a tilted position.

32. The hospital bed of claim 31 wherein the tilt frame comprises a rigid longitudinal frame member to support the patient deck.

33. The hospital bed of claim 31 wherein a tilt actuator rotates the patient deck.

34. The hospital bed of claim 31 wherein the tilt frame is hingedly connected to the frame.

35. The hospital bed of claim 31 further including an intermediate frame assembly connected to the frame, wherein one or more actuators raise and lower each end of the intermediate assembly.

36. The hospital bed of claim 1 further including a weighing system.

37. The hospital bed of claim 36 wherein the weighing system includes a load cell.

38. The hospital bed of claim 1 further including a locking system that stabilizes the bed prior to the patient deck being rotated into a tilted position.

39. The hospital bed of claim 38 wherein at least one caster is in contact with the floor when the patient deck is in the tilted position.

40. The hospital bed of claim 38 wherein the locking system is in a lock mode before allowing the patient deck to go into the tilted position.

41. The hospital bed of claim 38 wherein the locking system includes a brake lock function, when the patient deck is in the tilted position, the locking system prevents the brake lock function from becoming disengaged until the patient deck is rotated back to a generally horizontal position.

42. The hospital bed of claim 38 wherein the locking system includes a first brake pedal, a second brake pedal, the brake pedals are connected to the locking system, the first and second brake pedals independently control the locking system.

43. The hospital bed of claim 38 wherein the locking system stabilizes the bed by locking the at least one caster.

44. The hospital bed of claim 38 wherein the locking system includes an actuator.

45. The hospital bed of claim 1 wherein the patient deck includes a head section, the plurality of siderails includes a first siderail provided toward the head section, and a second siderail provided toward the head section.

46. The hospital bed of claim 45 wherein the plurality of siderails includes a third siderail provided toward a foot end of the bed, and a fourth siderail provided toward the foot end.

47. The hospital bed of claim 1 wherein the plurality of siderails has a first position and a second position.

* * * * *